US006527386B1

(12) United States Patent
Blank et al.

(10) Patent No.: US 6,527,386 B1
(45) Date of Patent: Mar. 4, 2003

(54) COMPLIANT IMAGING SURFACE FOR OFFSET PRINTING

(75) Inventors: Jeffrey K. Blank, Tigard, OR (US); Clark W. Crawford, Los Angeles, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/159,647

(22) Filed: May 30, 2002

(51) Int. Cl.[7] ..... B41J 2/01
(52) U.S. Cl. ..... 347/103
(58) Field of Search ..... 347/103, 120, 347/20, 123, 111, 159, 141, 155, 127, 128, 17, 154, 61; 399/271, 290, 292, 293, 294, 33, 67, 320, 330

(56) References Cited

U.S. PATENT DOCUMENTS

| | | | | |
|---|---|---|---|---|
| 5,389,958 | A | 2/1995 | Bui et al. | 347/103 |
| 5,805,191 | A | 9/1998 | Jones et al. | 347/103 |
| 6,196,675 | B1 | 3/2001 | Delly et al. | 347/103 |

*Primary Examiner*—Raquel Yvette Gordon
(74) *Attorney, Agent, or Firm*—Philip T. Virga

(57) ABSTRACT

A compliant imaging surface for offset printing comprising a drum having an outer compliant elastomeric layer affixed to the drum, the outer compliant elastomeric layer being sufficiently compliant to contact ink pixels having at least first and second heights so as to fix the ink pixels to the final receiving medium. A second outer rigid layer is affixed to the outer compliant elastomeric layer and acts to keep pressure across a span of one pixel with the outer compliant elastomeric layer acting to allow deformation on the pixel to pixel span.

20 Claims, 2 Drawing Sheets

COMPLIANT IMAGING SURFACE FOR OFFSET PRINTING

CROSS REFERENCE TO RELATED APPLICATIONS

Attention is directed to copending applications Ser. No. 10/000,345 filed herewith, entitled, "Controlling Gloss in an Offset Ink Jet Printer" and Ser. No. 10/000,336 filed herewith, entitled, "Continuous Transfer and Fusing Application System." The disclosure of these references is hereby incorporated by reference in their entirety.

FIELD OF INVENTION

The present invention relates generally to a drum for fixing an ink image on a receiving medium and, more particularly, to a multi-layer drum that creates a narrow, high pressure nip and includes an outer compliant elastomeric layer that provides improved ink image fixation on the receiving medium with reduced thermal requirements.

BACKGROUND OF THE INVENTION

For printing in a solid-ink printer, a common method of applying droplets of ink onto a piece of paper is to directly print the image onto the paper, i.e., a process known as direct printing. However, direct printing has many disadvantages. First, the head to paper gap must be adjusted for different media in order to control drop position. Second, there is the well-known paper hand-off problem between the rollers that guide the paper, because of the large size of the head. Third, there is a concern that head reliability will decrease because the paper is near the head. These problems are addressed with an offset process. In this process, the ink is first applied to a rotating drum and is then transferred off the drum and fixed into the paper in a single pass. This process is known as a transfix process or a transfuse process. Therefore, a single drum surface transfers the image, spreads the pixels, penetrates the pixels into the media, and controls the topography of the ink to increase paper gloss and transparency haze. The process requires a delicate balance of drum temperature, paper temperature, transfix load, and drum and transfix roller materials and properties in order to achieve image quality. These combined requirements reduce the drum material possibilities mainly due to wear of weaker materials, which result in gloss and haze degradation.

Ink jet printing systems utilizing intermediate transfer ink jet recording methods, such as that disclosed in U.S. Pat. No. 5,389,958 entitled IMAGING PROCESS and assigned to the assignee of the present application (the '958 patent) is an example of an indirect or offset printing architecture that utilizes phase change ink. A release agent application defining an intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred to the final receiving substrate.

In this standard offset process, the release agent application must be applied every print. This provides a release layer that facilitates image transfer. Therefore, unlike a typical laser printer process in which the deposition of the toner onto the paper and the fusing of the paper occurs in parallel (at the same time), the current solid-ink process operates in series. Therefore, to increase print speed, this architecture requires very high transfix velocities and release agent application. High transfix velocities are not very compatible with the current transfix process because of the combined paper preheat and duplex requirements (as the transfix velocity increases, the paper preheater temperature must increase to achieve the same exit paper temperature and if the preheat temperature is over about 60–65 degree C. the duplex image will smear). However, even in the fastest of possible speeds, this serial process drastically decreases the print speed. Higher loads can be used to offset some of the losses due to high transfix velocities, however, even now the required loads with this process are very high (currently about 800 lbs).

Additionally, it is known that higher drum temperature is better for drop spread and image durability. However, in current systems the drum temperature is limited by the cohesive failure of the ink. Cohesive failure results from the ink layer fracturing as the ink and paper leave the nip instead of the oil layer splitting which would normally allow complete transfer of the ink off the drum and onto the paper. Due to the large thermal mass of the imaging drum and the relatively short time required to transfix an image, there is no time for heating or quenching in a transfix nip. Therefore, the transfix temperature in these systems is limited by the cohesive failure of the ink.

To provide acceptable image transfer and final image quality, an appropriate combination of pressure and temperature must be applied to the ink image on the final receiving substrate. U.S. Pat. No. 6,196,675 entitled APPARATUS AND METHOD FOR IMAGE FUSING and assigned to the assignee of the present application (the '675 patent) discloses a roller for fixing an ink image on a final receiving substrate. The preferred embodiment of the roller is described in the context of an offset ink jet printing apparatus similar to the one described in the '958 patent. In this embodiment, an apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. Utilizing separate image transfer and image fusing operations allows improved image fusing and faster print speeds. The secondary fusing operation enables the image transfer process to use reduced pressures, whereby the load on the drum and transfer roller is reduced. Therefore what is needed is a transfer surface application system that overcomes the drawbacks of previous application systems using separate transfer and fusing operations.

SUMMARY OF THE INVENTION

It is an object of the present invention to provide an improved imaging apparatus and method for a compliant surface for near perfect image transfer and a secondary fuser that is capable of operating at a temperature more independent of the cohesive failure limits.

It is yet another objective of the present invention to provide an improved apparatus and method for applying a compliant surface that increase the reliability of the printer, decreases the noise and decreases the cost of the release agent system.

Accordingly, the present invention is a compliant imaging surface for offset printing comprising a drum having an outer compliant elastomeric layer affixed to the drum. The outer compliant elastomeric layer is sufficiently compliant to contact ink pixels having at least first and second heights so as to fix the ink pixels to the final receiving medium. A second outer rigid layer is affixed to the outer compliant elastomeric layer wherein the second outer rigid layer is thinner than the outer compliant elastomeric layer and acts to keep pressure across a span of one pixel with the outer compliant elastomeric layer acting to allow deformation on the pixel to pixel span.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are. capable of modifications in various, obvious aspects all without departing from the invention. Accordingly, the drawings and descriptions will be regarded as illustrative in nature and not as restrictive.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE INVENTION

Figure 1:
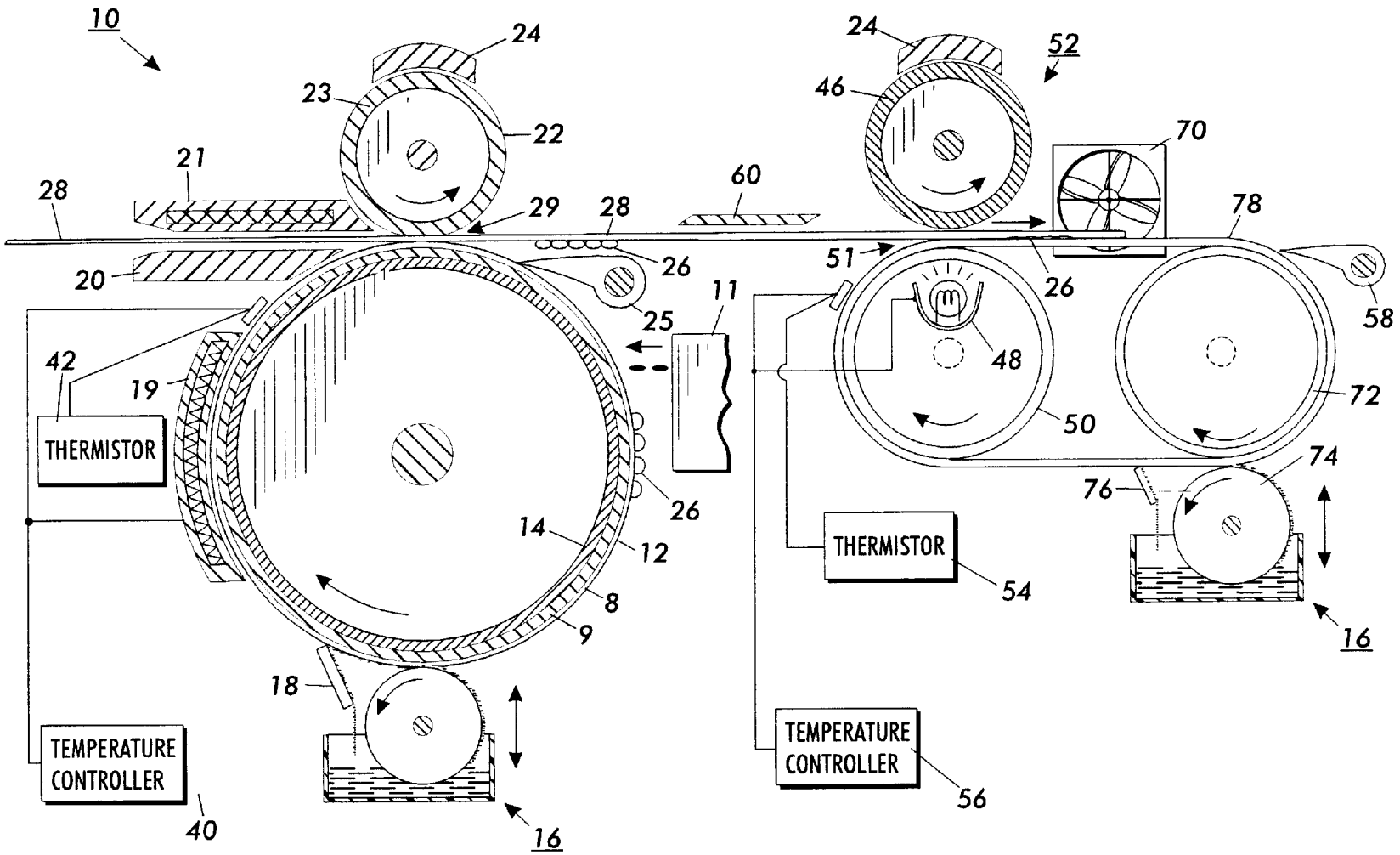
FIG. 1 is a diagrammatic illustration for applying a two-step transfix process in an ink jet printing system.

FIG. 1 discloses a diagrammatical illustration of an imaging apparatus 10 of the present invention for applying a two-step transfix process whereby a hot melt ink is printed onto an elastomer transfer surface for transference to a receiving substrate and then transported through a fuser for post fusing. Referring to FIG. 1 wherein like numerals refer to like or corresponding parts throughout, there is shown a print head 11 having ink jets supported by appropriate housing and support elements (not shown) for either stationary or moving utilization to deposit ink onto an intermediate transfer surface 12. The ink utilized is preferably initially in solid form and then changed to a molten state by the application of heat energy to raise the temperature from about 85 degrees to about 150 degrees centigrade. Elevated temperatures above this range will cause degradation or chemical breakdown of the ink. The molten ink is then applied in raster fashion from ink jets in the print head 11 to the intermediate transfer surface 12 forming an ink image. The ink image is then cooled to an intermediate temperature and solidifies to a malleable state wherein it is transferred to a receiving substrate or media 28 and then post fused. The details of this process will now be more fully described below.

In accordance with the present invention, a supporting surface 14 which is shown in FIG. 1 has affixed an outer compliant elastomer layer 9 defining a release surface. The intermediate transfer surface 12 is a liquid layer applied to the outer compliant elastomer layer 9 on drum 14 by contact with an applicator assembly 16. By way of example, but not of limitation, applicator assembly 16 comprises a wicking roller impregnated with a release liquid for applying the liquid and a metering blade 18 for consistently metering the liquid on the surface of the drum 14. Suitable release liquids that may be employed to form the intermediate transfer surface 12 include water, fluorinated oils, glycol, surfactants, mineral oil, silicone oil, functional oils or combinations thereof. As the drum 14 rotates about a journalled shaft in the direction shown in FIG. 1, applicator assembly 16 is raised by the action of an applicator assembly cam and cam follower (not shown) until the wicking roller is in contact with the surface of the drum 14.

Referring once again to FIG. 1, the release liquid that forms the intermediate transfer surface 12 on outer compliant elastomeric layer 9 is heated by an appropriate heater device 19. The heater device 19 may be a radiant resistance heater positioned as shown or positioned internally within the drum 14. Heater device 19 increases the temperature of the intermediate transfer surface 12 from ambient temperature to between 25 degrees to about 70 degrees centigrade or higher to receive the ink from print head 11. This temperature is dependent upon the exact nature of the liquid employed in the intermediate transfer surface 12 and the ink used and is adjusted by temperature controller 40 utilizing thermistor 42. Ink is then applied in molten form from about 85 degrees to about 150 degrees centigrade to the exposed surface of the liquid intermediate transfer surface 12 by the print head 11 forming an ink image 26. The ink image 26 solidifies on the intermediate transfer surface 12 by cooling down to the malleable intermediate state temperature provided by heating device 19. A receiving substrate guide apparatus 20 then passes the receiving substrate 28, such as paper or transparency, from a positive feed device (not shown) and guides it through a nip 29. Opposing arcuate surfaces of a roller 23 and the drum 14 forms the nip 29. In one embodiment, the roller 23 has a metallic core,. preferably steel with an elastomer coating 22. The drum 14 having the outer compliant elastomer layer 9 continues to rotate, entering the nip 29 formed by the roller 22 with the curved surface of the intermediate transfer surface 12 containing the ink image 26. The ink image 26 is then deformed to its image conformation and adhered to the receiving substrate 28 by being pressed there against. The elastomer coating 22 on roller 23 engages the receiving substrate 28 as shown in FIG. 2 on the reverse side to which the ink image 26 is transferred.

Referring once again to FIG. 2 and in accordance with one embodiment of the present invention, the drum 14 is preferably made from aluminum wherein the outer compliant elastomeric layer 9 is sufficiently compliant to contact ink pixels having at least first and second heights, 5 and 7 respectively so as to fix the ink pixels to the final receiving medium 28. The ink image 26 is effectively transferred to the final receiving medium 28 to achieve maximum image quality while minimizing wrinkling or other degradation of the ink image 26 on the final receiving medium 28. The outer compliant elastomeric layer may have a hardness of about 80 Shore A with thickness of about 0.004 inches. Additionally, the outer compliant elastomeric layer 9 may be composed of either urethane or silicone.

Figure 3:
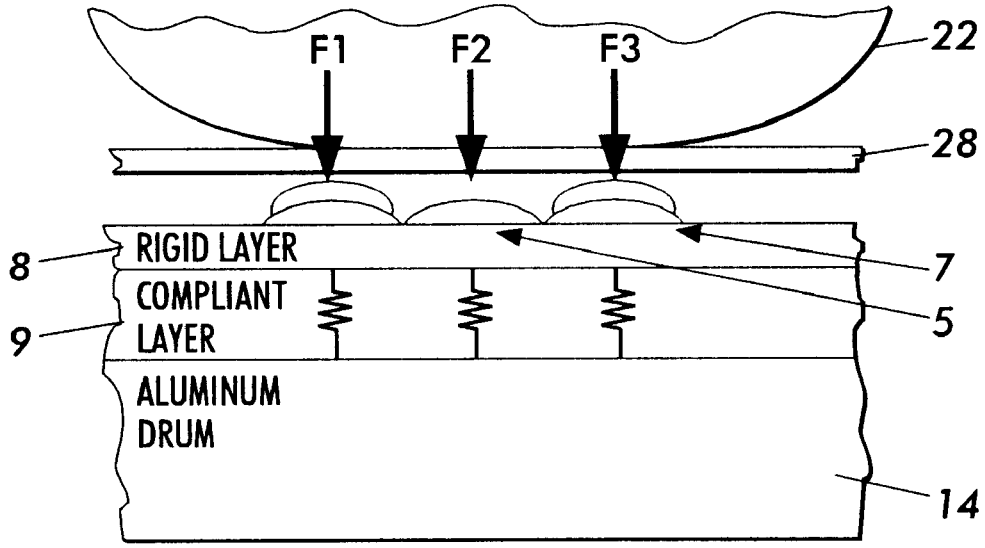
FIG. 3 is an enlarged diagrammatic illustration of the transfer of an ink image from an compliant elastomeric, layer in combination with a rigid layer to a receiving substrate in accordance with the present invention.

Referring once again to FIG. 1, there is shown another embodiment of the present invention the drum 14 wherein a second outer rigid layer 8 is affixed to the outer compliant elastomeric layer 9. Referring to FIG. 3, the second outer rigid layer 8 is thinner than the outer compliant elastomeric layer 9. The thinner second outer rigid layer 8 acts to keep pressure across a span of one pixel 5 and the outer compliant elastomeric layer 9 acts to allow deformation on the pixel to pixel span, 5 and 7 respectively so as to fix the ink pixels to the final receiving medium 28. The second outer rigid layer 8 may have a hardness of about 70 Shore D with a thickness of about 0.001 inches. Additionally, the second outer rigid layer 8 may be composed of elastomer, plastic or be a plated metallic surface over the outer complaint elastomer layer 9.

Figure 2:
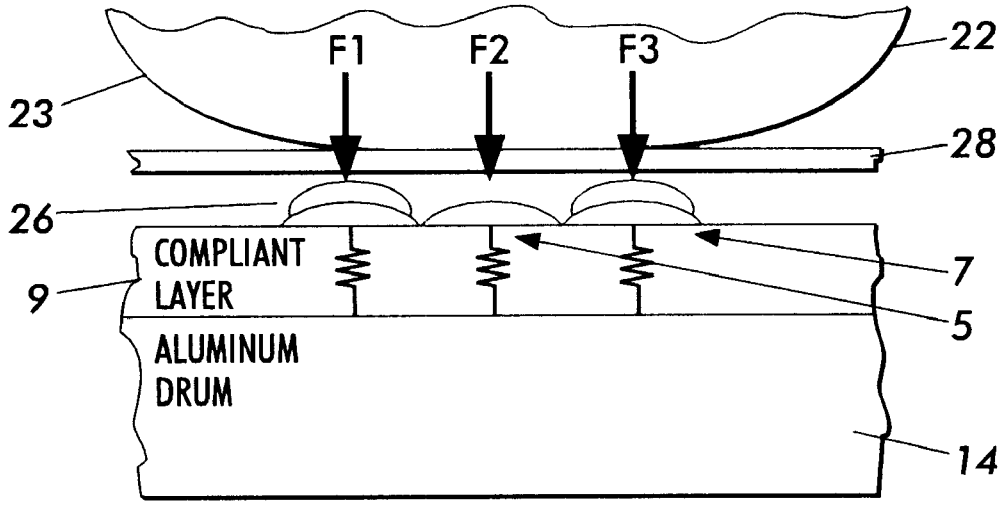
FIG. 2 is an enlarged diagrammatic illustration of the transfer of an ink image from a compliant elastomeric layer to a receiving substrate.

Turning back to FIG. 1, and using either configuration for the drum 14 as shown in FIGS. 2 and 3, the ink image 26 is first applied to the intermediate transfer surface 12 on the outer compliant surface 8 or rigid layer 9 and then transfixed off onto the receiving substrate or media 28. The ink image 26 is thus transferred and fixed to the receiving substrate 28 by the pressure. exerted on it in the nip 29 by the resilient or elastomeric surface 22 of the roller 23. By way of example only, the pressure exerted may be less than 800 lbf on the receiving substrate or media. Stripper fingers 25 (only one of which is shown) may be pivotally mounted to the imaging apparatus 10 to assist in removing any paper or other final receiving substrate 28 from the exposed surface of the liquid layer forming the intermediate transfer surface 12. After the ink image 26 is transferred to the receiving substrate 28 and before the next imaging, the applicator assembly 16 and metering blade 18 are actuated to raise upward into contact with the drum 14 to replenish the liquid intermediate transfer surface 12.

A heater 21 may be used to preheat the receiving surface 28 prior to the fixation of the ink image 26. The heater 21 may be set to heat from between about 60 degrees to about 200 degrees centigrade. It is theorized that the heater 21 raises the temperature of the receiving medium to between about 90 degrees to about 100 degrees centigrade. However, the thermal energy of the receiving substrate 28 is kept sufficiently low so as not to melt the ink image upon transfer to the receiving substrate 28. When the ink image 26 enters the nip 29 it is deformed to its image conformation and adheres to the receiving substrate 28 either by the pressure exerted against ink image 26 on the receiving substrate 28 or by the combination of the pressure and heat supplied by heater 21 and/or heater 19. Additionally, a heater 24 may be employed which heats the transfer and fixing roller 23 to a temperature of between about 25 degrees to about 200 degrees centigrade. Heater devices 21 and 24 can also be employed in the paper or receiving substrate guide apparatus 20 or in the transfer and fixing roller 23, respectively. The pressure exerted on the ink image 26 must be sufficient to have the ink image 26 adhere to the receiving substrate 28 which is between about 10 to about 2000 pounds per square inch, and more preferably between about 750 to about 850 pounds per square inch.

After exiting the nip 29 created by the contact of the roller 23 and the outer compliant layer 9. and drum 14, the ink image can then be thermally controlled with a thermal device 60. This thermal device 60 can heat, cool, or maintain the temperature of the receiving substrate 28 and ink image 26 which may by way of example be between 50 to 100 degrees C. The highest temperature the receiving substrate 28 and ink image 26 can be increased to in this location is dependent on the melting or flash point of the ink and/or the flash point of the receiving substrate 28. The thermal device 60 could be as simple as insulation to maintain the temperature of the ink and substrate as it exits the nip 29, or a heating and/or cooling system to add or remove thermal energy. The receiving substrate 28 and ink image 26 are then transported to a fuser 52. The fuser 52 is composed of a back-up roller 46 and a fuser roller 50. The back-up roller 46 and fuser roller 50 have metallic cores, preferable steel or aluminum, and may be covered with elastomer layers 54 and 56, respectively. The back-up roller 46 engages the receiving substrate 28 and ink image 26 on the reverse side to which the ink image 26 resides. This fuses the ink image 26 to the surface of the receiving substrate 28 so that the ink image 26 is spread, flattened, penetrated and adhered to the receiving substrate 28. The pressure exerted by the fuser may be between 100 lbf to about 2000 lbf by way of example.

When the receiving substrate 28 and ink image 26 enter the fuser 52 their temperature will change as determined by the transient heat transfer of the system during the dwell in a nip 51 formed by the fuser roller 50 and the back-up roller 46. Depending on the temperature of the back-up roller 46 and fuser roller 50, the transient temperature of the receiving substrate 28 and. ink image 26 throughout their thickness can be controlled by either quenching or hot fusing. If the receiving substrate 28 and ink image 26 are brought into the fuser nip 51 hotter than the fuser roller 50 and the back-up roller 46, the ink image 26 will be quenched to a cooler temperature. This is referred too as quench fusing. If the receiving substrate 28 and ink image 26 is brought into the fuser nip 51 cooler than the fuser roller 50 and the back-up roller 46, the ink image 26 will be heated to a higher temperature, say between 75–100° C. This is referred to as hot fusing. This process allows pressure to be applied to the receiving substrate 28 and ink image 26 at temperatures unachievable in the first nip 29. This is done by quenching the receiving substrate 28 and ink image 26 from a high temperature, say 80–85° C. down to a lower temperature, say 55–65° C. where the ink image 26 has enough cohesive strength to remain intact as it exits the fuser.

Additionally, the above fusing process may also be accomplished by heating the secondary fuser nip 51 such that the ink image 26 near the surface of the receiving substrate 28 is hotter than the ink image near the surface of the fuser roller 50. This allows cool enough ink temperatures for release from the fuser roller 50 and higher temperatures near the receiving substrate 28, which increase spread, flattening, penetration and adhesion. In the case that the fuser roller 50 is a belt instead of a roller, the receiving substrate 28 and ink image 26 can be held against the belt for a distance past the nip 51 formed by the secondary fuser 50 and back-up roller 46. This allows the ink sufficient time to cool to a temperature low enough to allow it to be stripped from the belt. It should be understood that the temperature of the fuser 52 can be different to that of the receiving substrate 28 and ink image 26 and is controlled with a separate control system 56 consisting of a heater 48, and thermistor 54, as is shown in FIG. 1. Stripper fingers 58 (only one of which is shown) may be pivotally mounted to the fuser roller 50 to assist in removing any paper or receiving substrate from the surface of the fuser roller 50. The ink image 26 then cools to ambient temperature where it possesses sufficient strength and ductility to ensure its durability.

In summary, the present invention utilizes an outer compliant elastomer surface for near perfect image transfer and a post fuser that is capable. of operating at a temperature more independent of the cohesive failure limits. These two steps separate the requirements of ink transfer and ink spreading, topography, and penetration into the paper and will be easier to optimize for life than a single system that must perform both operations. Additionally, the two steps can be optimized. individually to be smaller and cheaper than one more complex system while providing an opportunity to increase the durability of solid-ink by combining a very hot fuser temperature or a quench fuse independent of the transference process.

While the invention has been described above with reference to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A compliant imaging surface for offset printing, comprising: a drum;

an outer compliant elastomeric layer affixed to the drum, the outer compliant elastomeric layer being sufficiently compliant to contact ink pixels having at least first and second heights so as to fix the ink pixels to the final receiving medium, whereby the ink image is effectively transferred to the final receiving medium to achieve maximum image quality while minimizing wrinkling or other degradation of the ink image on the final receiving medium.

2. The compliant imaging surface according to claim 1, wherein the drum is made from aluminum.

3. The compliant imaging surface according to claim 1, wherein the outer compliant elastomeric layer is about 80 Shore A.

4. The compliant imaging surface according to claim 1, wherein the outer compliant elastomeric layer has a thickness of about 0.004 inches.

5. The compliant imaging surface according to claim 1, wherein the outer compliant elastomeric layer is composed of urethane.

6. The compliant imaging surface according to claim 1, wherein the outer compliant elastomeric layer is composed of silicone.

7. The compliant imaging surface according to claim 1, wherein a second outer rigid layer is affixed to the outer compliant elastomeric layer wherein the second outer rigid layer is thinner than the outer compliant elastomeric layer whereby the thinner second outer rigid layer acts to keep pressure across a span of one pixel and the outer compliant elastomeric layer acts to allow deformation on the pixel to pixel span.

8. The compliant imaging surface according to claim 7, wherein the second outer rigid layer is about 70 Shore D.

9. The compliant imaging surface according to claim 1, wherein the second outer rigid layer has a thickness of about 0.001 inches.

10. The compliant imaging surface according to claim 1, wherein the second outer rigid layer is composed of an elastomer.

11. The compliant imaging surface according to claim 1, wherein second outer rigid layer is composed of a plastic.

12. The compliant imaging surface according to claim 1, wherein second outer rigid layer is a plated metallic surface over the outer complaint elastomer layer.

13. A compliant imaging surface for offset printing, comprising:

a cylindrical aluminum drum;

an outer compliant elastomeric layer affixed to the drum; and a second outer rigid layer affixed to the outer compliant elastomeric layer wherein the second outer rigid layer is thinner than the outer compliant elastomeric layer.

14. The compliant imaging surface according to claim 13, wherein the outer compliant elastomeric layer is about 80 Shore A and the second outer rigid layer is about 70 Shore D.

15. The compliant imaging surface according to claim 13, wherein the outer compliant elastomeric layer has a thickness of about 0.004 inches and the second outer rigid layer has a thickness of about 0.001 inches.

16. The compliant imaging surface according to claim 13, wherein the outer compliant elastomeric layer is composed of urethane.

17. The compliant imaging surface according to claim 13, wherein the outer compliant elastomeric layer is composed of silicone.

18. The compliant imaging surface according to claim 1, wherein the second outer rigid layer is composed of an elastomer.

19. The compliant imaging surface according to claim 1, wherein second outer rigid layer is composed of a plastic.

20. A compliant imaging surface for offset printing, comprising:

a cylindrical aluminum drum;

an outer compliant elastomeric layer affixed to the drum, the outer compliant elastomeric layer being sufficiently compliant to contact ink pixels having at least first and second heights so as to fix the ink pixels to the final receiving medium; and a second outer rigid layer affixed to the outer compliant elastomeric layer wherein the second outer rigid layer is thinner than the outer compliant elastomeric layer and acts to keep pressure across a span of one pixel with the outer compliant elastomeric layer acting to allow deformation on the pixel to pixel span, whereby the ink image is effectively transferred to the final receiving medium to achieve maximum image quality while minimizing wrinkling or other degradation of the ink image on the final receiving medium.

* * * * *